United States Patent [19]

Critchett

[11] 3,971,327

[45] July 27, 1976

[54] MULTIPURPOSE TABLE

[76] Inventor: Paul J. Critchett, 10 Elm Ave., San Anselmo, Calif. 94960

[22] Filed: Jan. 27, 1975

[21] Appl. No.: 544,354

[52] U.S. Cl. ..... 108/60; 108/159

[51] Int. Cl.[2] ..... A47B 37/00

[58] Field of Search .....108/60, 11, 153, 150, 159; 312/196; 248/158, 302; 211/184

[56] References Cited

UNITED STATES PATENTS

| | | | |
|---|---|---|---|
| 432,425 | 7/1890 | Moan | 108/159 |
| 2,347,821 | 5/1944 | Goldner | 108/159 |
| 2,656,045 | 10/1953 | Curtis | 108/159 |
| 2,683,010 | 7/1954 | Hamerslag, Jr. | 108/60 |
| 2,954,953 | 10/1960 | Mallet-Prevost | 108/150 |
| 3,185,115 | 5/1965 | Rand | 108/60 |
| 3,339,502 | 9/1967 | Fyffe | 108/60 |
| 3,550,540 | 12/1970 | Albrecht | 108/60 |

*Primary Examiner*—James T. McCall
*Assistant Examiner*—Darrell Marquette
*Attorney, Agent, or Firm*—Naylor, Neal & Uilkema

[57] ABSTRACT

A table comprised of a flat top having partitions removably secured thereto to divide the top into isolated work areas and a platform removably secured to the upper edges of the panels to adapt the table for use as a climbing and crawling toy for children. The partitions are received within slots in the top and provided with interlocking edges which secure the partitions against lateral movement relative to one another when received within the slots. Crawl holes are provided in the partitions and the platform so that children may crawl therethrough and tool boards are provided to cover the holes in the partitions when so desired.

8 Claims, 7 Drawing Figures

MULTIPURPOSE TABLE

BACKGROUND OF THE INVENTION

The present invention relates to a combination table, workbench and climbing toy and particularly is concerned with such an apparatus which may be readily converted to any one of the uses for which it is adapted.

The prior art relating to convertible tables and the like is typified by foldable tables and display devices adapted to be knocked down for storage purposes. Tables employing partition-like elements somewhat similar to those of the present invention are also found in the art relating to ornamental tables. U.S. Pats. Nos. 245,540; 1,800,685; 2,689,050; 3,850,189; 3,685,664; and 3,731,639 are representative of the art in both of these categories. Somewhat significant prior art is also found in the prior patents on stools and the like, as may be seen from U.S. Pat. No. 3,381,189.

Although the abovementioned prior art bears certain similarities to the table of the present invention, it is totally lacking of any suggestion of the simple and rugged construction which facilitates the table's use as a children's table, workbench or climbing toy. It is also lacking of the self-locking joints of the invention which facilitates the components thereof for secure interengagement and ready disengagement.

SUMMARY OF THE INVENTION

The basic table of the present invention comprises a generally planar top having an upper surface with slots formed therein for the receipt of partitions and a plurality of partitions received within the slots and extending upwardly from the top to divide its upper surface into a plurality of work areas which are isolated from one another by the partitions. The partitions are removable from the slots to convert the upper surface of the top into a condition wherein it is not interrupted by the partitions. A platform is receivable on the upper edge portions of the partitions and grooves are provided on the platform to secure it in place on the partitions.

A principal object of the present invention is to provide a convertible table which is of simple and rugged construction and incorporates secure joints which are selectively engagable and disengagable from one another.

Another object of the invention is to provide such a table which may be selectively used as an uninterrupted work surface, a workbench segmented into isolated work areas, or a climbing toy.

Still another object of the invention is to provide such a table which is stable and tilt resistant and wherein the component parts thereof are not susceptible to inadvertent dislodgement by children working and playing on the table.

A further object of the invention is to provide such a table which is of simple construction and may be manufactured from readily available material, such as wood, with conventional carpentry tools.

BRIEF DESCRIPTION OF THE DRAWINGS

The foregoing and other objects of the invention will become more apparent when viewed in light of the following detailed description and accompanying drawings wherein.

DESCRIPTION OF THE ILLUSTRATED EMBODIMENT

Figure 1:
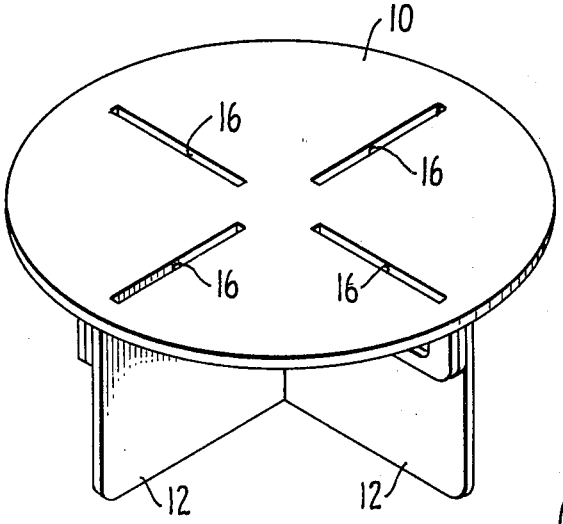
FIG. 1 is a perspective view of the table, with the partitions and platform removed therefrom.
Figure 7:
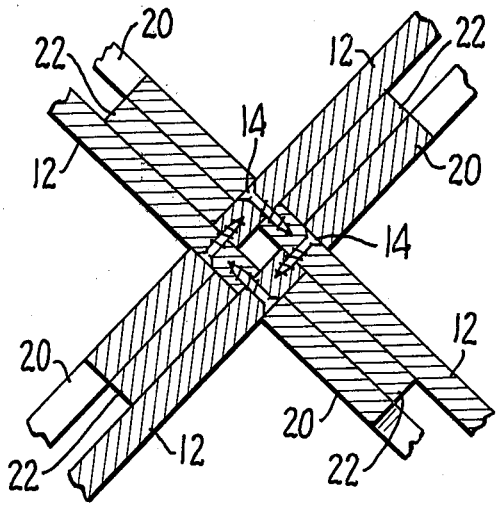
FIG. 7 is a view in horizontal cross-section, with parts thereof broken away, showing the joint between the panel-like legs of the table.

The base of the table is illustrated in FIG. 1 and comprises a top 10 having panel-like leg portions 12 fixed to the under side thereof. The leg portions 12 are arranged in cruciform pattern and secured to one another and to the top 10 through means of screws and glue. The cruciform arrangement of the legs and the screws securing the legs together may be seen from FIG. 7 wherein the screws are designated by the numeral 14. The top of the table has slots 16 formed therethrough so as to open to the under side thereof closely adjacent the sides of the respective leg portions 12.

Figure 4:
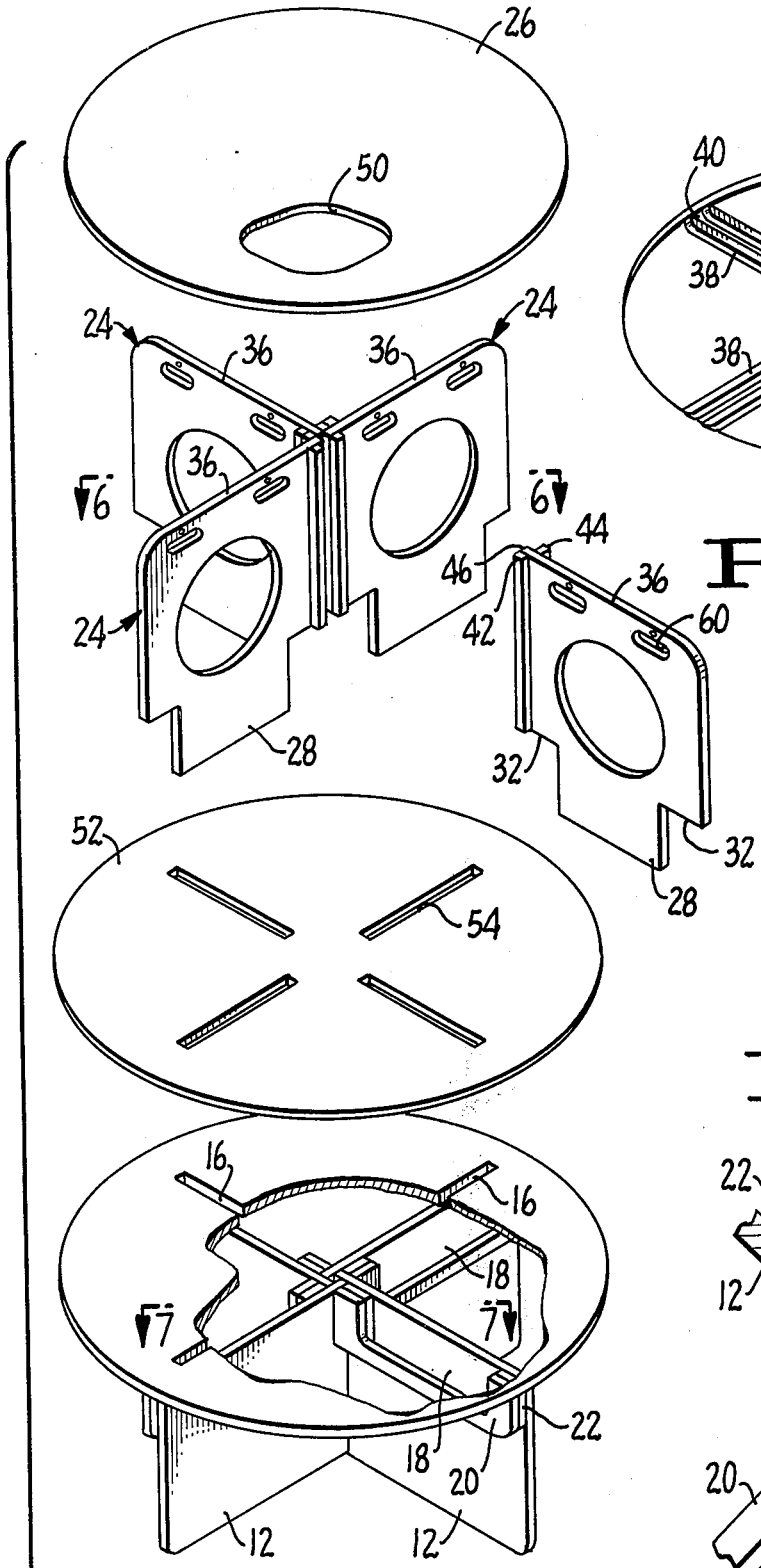
FIG. 4 is an exploded perspective view showing all elements of the table.

The interrelationship of the slots 16 and the leg portions 12 may best be seen from FIG. 4. That figure also shows pocket areas 18 disposed beneath and in aligned relationship with each of the slots 16. The pocket areas 18 comprise generally U-shaped retainers 20 secured in spaced relationship to the sides of the leg portions 12 by spacer members 22. The retainers and spacer members may be secured to one another and to the leg portions through any desired carpentry technique, such as screw fasteners and/or glue. It should be noted that all of the components of the table of the present invention, with the exception of the screw fasteners employed therein, are preferably fabricated of wood or hard board and that, accordingly, they may be readily assembled by conventional carpentry techniques.

Figure 2:
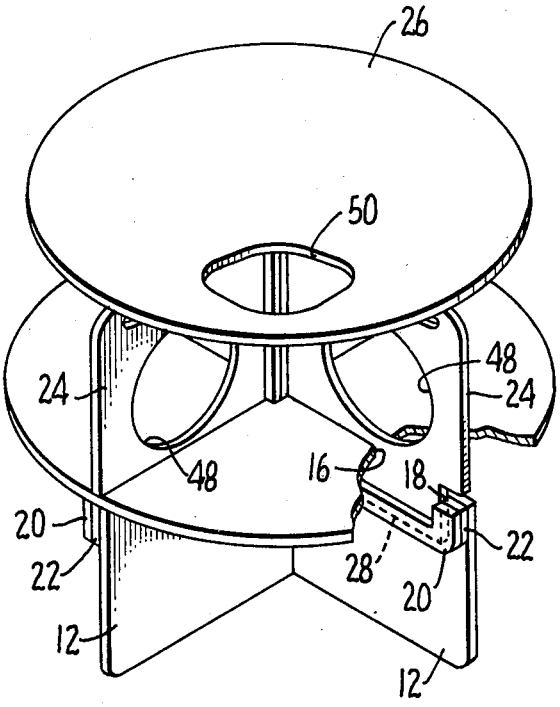
FIG. 2 is a perspective view of the table, with parts thereof broken away showing the partitions and climbing platform in place.
Figure 5:
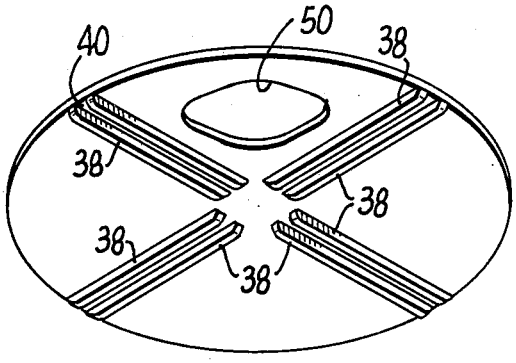
FIG. 5 is a perspective view of the under side of the climbing platform.

FIG. 2 shows the table assembled with removable partitions 24 received within the slots 16 and a climbing platform 26 supported on the partitions. The partitions are identical to one another in construction and may best be seen from FIG. 4 wherein they are shown in exploded perspective. Each partition comprises a tongue portion 28 proportioned for extension through a slot 16 and receipt within the pocket area 18 therebeneath between the leg portion 12 and the retainer 20; a body portion 30 having shoulders 32 adapted to rest on the top 10 when the tongue 28 is extended through a slot 16 in the top; and a lateral edge portion 34 for interlocking engagement with the corresponding edge portions of the other panels when the panels are all received in the slots 16. When the partitions 24 are received within the slots, the upper edges of the partitions, designated 36, are disposed in co-planar relationship to one another. The platform 26 is adapted to be supported on these edges and the under side of the platform is provided with rails 38 (See FIG. 5) to engage the partitions to either side thereof. The rails 38 are arranged in pairs with each pair defining a groove 40 therebetween which the upper edge of one of the partitions may be received.

Figure 6:
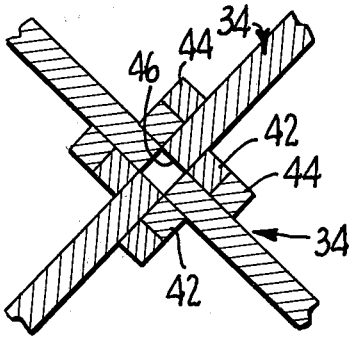
FIG. 6 is a view in horizontal cross-section, with parts thereof broken away, showing the joint formed between the partitions when they are in place in the table.

The detailed construction of the lateral edge portions 34 and the manner in which the edge portions of the respective partitions engage when the table is assembled may best be seen from FIG. 6. There it can be seen that each edge portion 34 comprises a rail 42 extending laterally from one side of the partition at the distal end thereof and a rail 44 extending laterally from the other side of the partition in spaced relationship to the distal end thereof. The spaced relationship is such that the rails 44 are spaced from the distal ends of the partitions by a distance substantially equal to the thickness of the rails 42. For the sake of illustration, the distal end of the upper righthand partition in FIG. 6 is designated by the numeral 46.

When the partitions are in place and the lateral edge portions thereof are engaged, as illustrated in FIG. 6, the rails interlock with one another to lock the partitions against relative lateral movement relative to one another. This results because the rails of each partition assume abutting relationship with respect to the rails of the partitions adjacent thereto. The identical configuration of the lateral edge portions facilitates assembly of the partitions into place without regard for which partition is received in a particular slot 16.

The partitions 24 are each provided with a climbing hole 48 whereby a child may climb through the partition from one area of the top to another when the partitions are received in place within the slots 16. It is noted that without the presence of the holes 48, the partitions would function to isolate the top into quadrants when received within the slots 16. The top 26 is also provided with a climbing hole, designated 50. The purpose of the hole 50 is to enable a child to climb through the platform 26 to and from the area of the table therebeneath. In the preferred embodiment illustrated, the hole 50 is positioned so as to be in alignment with the area between two adjacent partitions 24. Thus, a child may climb through the holes in the partitions and, thence, through the hole 50 to the top of the platform 26. The rails 38 function to secure the platform in place and against tilting or dislodgment during the course of such climbing.

Figure 3:
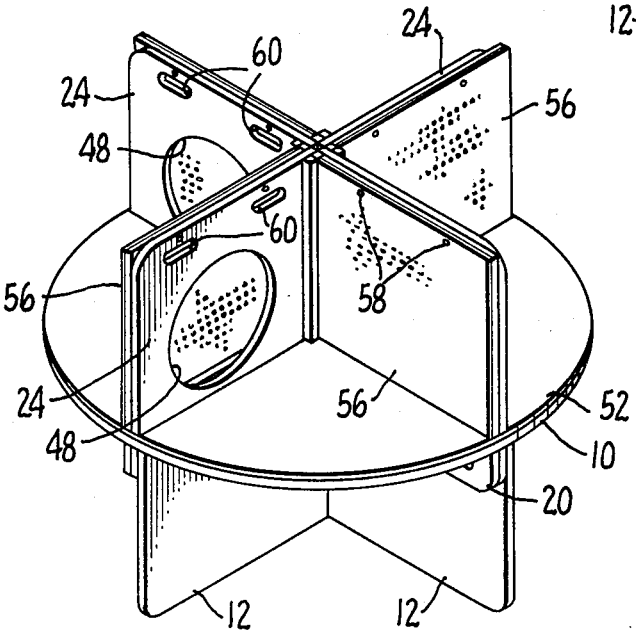
FIG. 3 is a perspective view of the table showing a protective cover applied to the top of the table and the partitions in place with tool boards mounted thereon and the climbing platform removed therefrom.

FIG. 3 illustrates the table in condition for use as a workbench separated into four isolated work areas. In this condition, a hard board sheet 52 is received on the upper surface of the top 10 to protect the surface from impact and abrasion. The sheet has a plan configuration identical to that of the top 10 and includes slots 54 adapted to align with the slots 16. In the assembled conditon shown in FIG. 3, the sheet is held in place under the influence of gravity and as a result of engagement of the shoulders 32 of the partitions on the upper surfaces of the sheet. As conditioned in FIG. 3, the climbing platform 26 is removed from the upper edges of the partitions 24 and tool boards 56 are secured in place over the partitions to close the holes 48 therein. The tool boards are preferably fabricated of pegboard provided with a peripheral framework for engagement with the partitions. Any suitable fasteners, such as machine bolts with wing nuts thereon, may be used to hold the tool boards in place. For the sake of illustration, fasteners 58 are shown in FIG. 3. As illustrated, these fasteners would extend through the tool boards and openings provided therefor in the partitions.

With the table conditioned as illustrated in FIG. 3, four distinct work areas are provided and each area is separated from those areas adjacent thereto. In addition to providing for closure of the climbing holes 48, the tool boards also provide a convenient place where tools may be mounted for ready accessibility to a child working at the table. If desired, suitable outlines may be provided on the tool boards to show where particular tools should be hung.

Each of the partitions 24 is provided with a pair of hand holes 60 to facilitate handling of the partition. In the preferred embodiment illustrated, the tool boards 56 are proportioned to cover these holes when the boards are in place.

In summary, the present invention provides a table capable of at least three relatively distinct uses. Namely, the table may be used as an uninterrupted work surface, as shown in FIG. 1; as a segmented climbing toy, as shown in FIG. 2; or, as a segmented workbench, as shown in FIG. 3. The table is readily convertible from one of these uses to the other by simply lifting the platform and partition elements to or from the desired assembled condition. No special tools or skills are required for so adjusting the table. When particular elements of the table are not in use, they are flat and may be readily stored.

From the foregoing detailed description, it is believed apparent that the present invention enables the attainment of the objects initially set forth herein. It should be understood, however, that the invention is not intended to be limited to the specifics of the illustrated embodiment, but rather is defined by the accompanying claims.

What is claimed is:

1. A multipurpose table comprising, in combination: a generally planar top supported on panel-like legs disposed in intersecting cruciform relationship relative to one another and fixedly connected to the under side of the top so as to extend generally normal thereto, said top having an upper surface and slots extending therethrough adjacent the connection of the legs to the undersurface; pockets supported on the panel-like legs in alignment with the slots extending through the top; partitions received within said slots and the pockets in alignment therewith, said partitions disposed in intersecting cruciform relationship to one another and extending upwardly from said top to divide the upper surface thereof into a plurality of work areas which are isolated from one another, said partitions being removable from said slots and pockets to convert the upper surface of the top into a condition wherein it is not interrupted by the partitions.

2. A table, according to claim 1, further comprising a crawl hole formed through at least one of said partitions whereby a child may crawl therethrough between the areas of the upper surface of the top to either side thereof.

3. A table, according to claim 2, further comprising a tool board proportioned for receipt over the opening formed in said partition and means to removably secure said board to the partition and over the opening therein.

4. A table, according to claim 1, wherein said partitions are proportioned to have generally coplanar upper edge portions when secured to the partition receiving means and further comprising a platform receivable on said upper edge portions, said platform having groove means thereon to secure the platform against lateral and tilting movement relative to the partitions when received on the upper edge portions thereof.

5. A table, according to claim 4, wherein said groove means comprises rails secured to the under side of the platform so as to extend to either side of each of the upper edge portions of the respective partitions when received thereon.

6. A table, according to claim 4, further comprising a crawl hole formed through at least one of said partitions whereby a child may crawl therethrough between the areas of the upper surface of the top to either side thereof and at least one crawl hole formed through the platform and communicating with one of said areas whereby a child may crawl through said platform to and from said one area.

7. A multipurpose table comprising, in combination: a generally planar top having an upper surface with slots formed therein for the receipt of partitions; a plurality of partitions received within said slots and extending upwardly from said top in a cruciform pattern, as viewed in plan, so as to intersect at a mid-portion of the top to divide the upper surface thereof into a plurality of work areas which are isolated from one another by the partitions, said partitions being removable from the slots to convert the upper surface of the top into a condition wherein it is not interrupted by the partitions; identically configured lateral edge portions disposed on said partitions for engagement with one another at said mid-portion to secure the partitions against relative lateral movement when the partitions are received within the slots, each said edge portion comprising a pair of protruding rails, one of which extends laterally from the distal end of one side of said edge portion and the other of which extends laterally from the other side of the edge portion in spaced relationship to the distal end thereof by a distance substantially equal to the thickness of said one rail.

8. A multipurpose table comprising, in combination: a generally planar top supported on panel-like legs fixed to the underside thereof and extending generally normal thereto, said top having an upper surface with partition receiving means thereon; a plurality of partitions secured to said partition receiving means and extending upwardly from said top to divide the upper surface thereof into a plurality of work areas which are isolated from one another, said partitions being removable from said partition receiving means to convert the upper surface of the top into a conditon wherein it is not interrupted by the partitions; identically configured lateral edge portions disposed on said partitions for engagement with one another to secure the partitions against relative lateral movement when the partitions are secured to the partition receiving means, each said edge portion comprising a pair of protruding rails, one of which extends laterally from the distal end of one side of the edge portion and the other of which extends laterally from the other side of the edge portion in spaced relationship to the distal end thereof by a distance substantially equal to the thickness of said one rail.

* * * * *